US006151801A

United States Patent [19]

Frederiksen et al.

[11] Patent Number: 6,151,801

[45] Date of Patent: Nov. 28, 2000

[54] SANDAL

[76] Inventors: Ben G. Frederiksen, 600 PCH #216; Gayle Trenberth, 600 Pacific Coast Hwy. #216, both of Seal Beach, Calif. 90740

[21] Appl. No.: 09/372,887

[22] Filed: Aug. 12, 1999

Related U.S. Application Data

[63] Continuation-in-part of application No. 09/174,376, Oct. 16, 1998, abandoned.

[51] Int. Cl.[7] ..... A43B 3/12

[52] U.S. Cl. ..... 36/11.5; 36/94

[58] Field of Search ..... 36/11.5, 7.5, 94, 36/8.1, 95, 106; 602/30

[56] References Cited

U.S. PATENT DOCUMENTS

| | | | |
|---|---|---|---|
| 2,506,308 | 5/1950 | Maynier | 36/11.5 |
| 2,740,207 | 4/1956 | Starensier | 36/11.5 |
| 2,751,693 | 6/1956 | Baker | 36/11.5 |
| 2,808,662 | 10/1957 | Webb | 36/11.5 |
| 4,207,880 | 6/1980 | Zinkovich | 602/30 |
| 5,802,737 | 9/1998 | Beppu | 36/11.5 |
| 5,870,837 | 2/1999 | Poulos | 36/11.5 |

*Primary Examiner*—Paul T. Sewell
*Assistant Examiner*—Jila M. Mohandesi

[57] ABSTRACT

A sandal including a sole portion having a front end and a rear end and a pair of sides. The sole portion is comprised of a plurality of layers of elastomeric material including a planar lower layer, an angling intermediate portion, and an upper layer adapted to receive the foot of a wearer thereon. The sole portion includes a plurality of intermediate layers. The upper layer is provided with a pair of longitudinal slits adjacent to the rear thereof and four circular holes adjacent to the front thereof. A top strap has an upper section positionable over the instep of a wearer's foot and a lower section positioned through the slits and extending there beneath. The strap has four apertures adjacent to the forward edge thereof in the upper portion. Two cords with four central extents each have two upper extents extending through associated apertures of the strap and two lower extents looped around the holes in the upper layer. Four cylindrical sleeves encompass the cords.

5 Claims, 3 Drawing Sheets

FIG 3
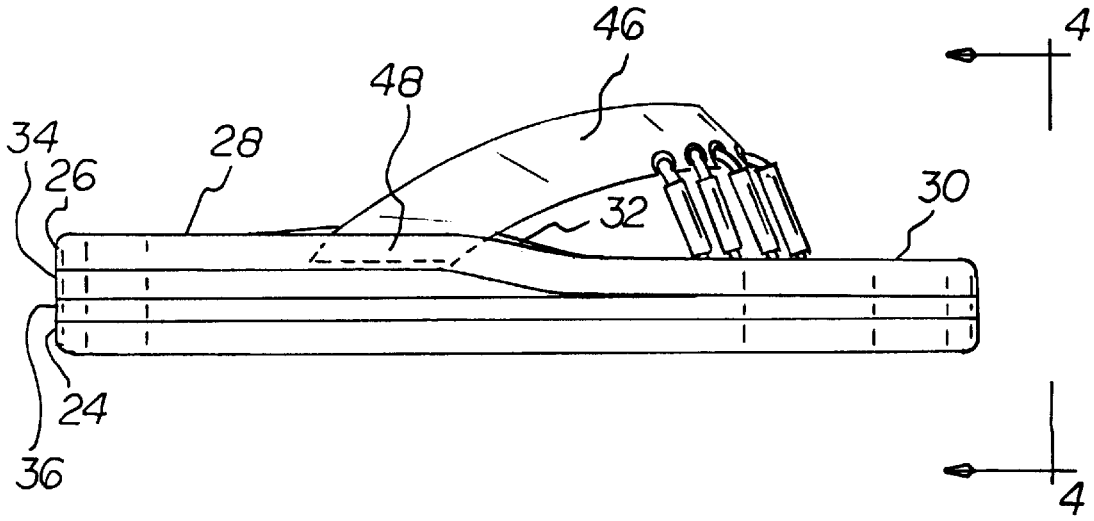
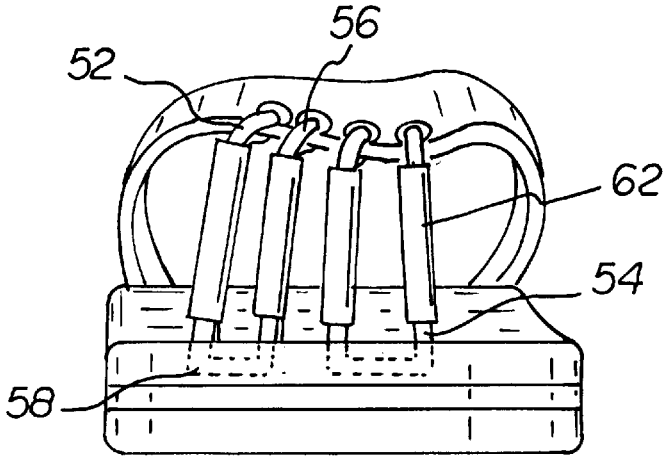
FIG 4

FIG 5
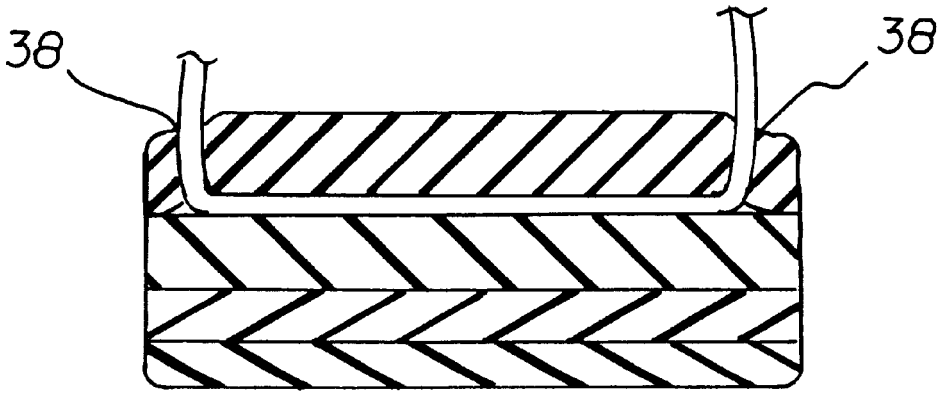
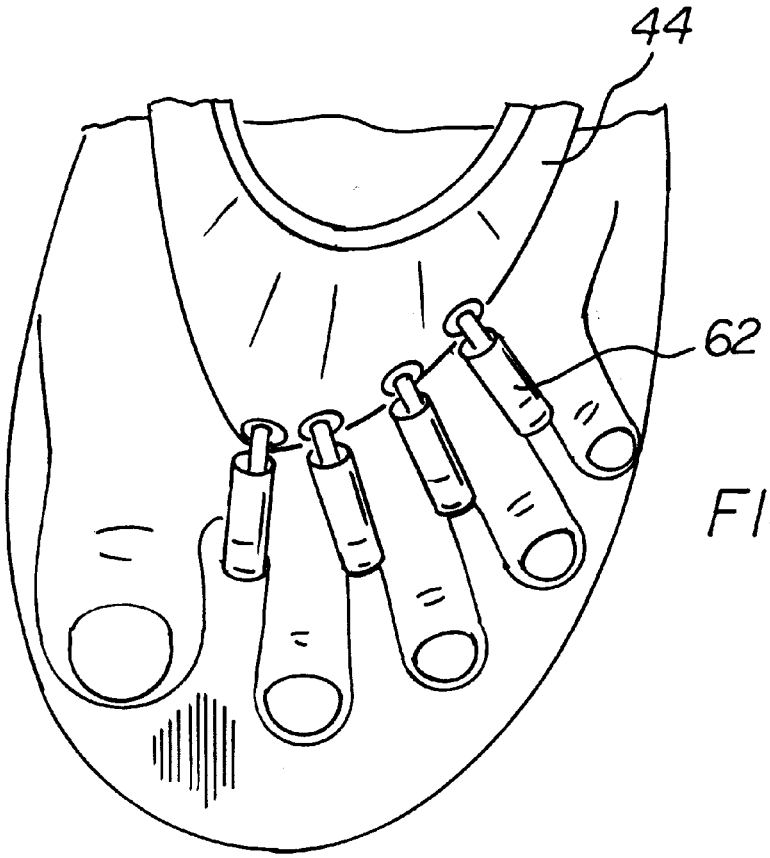
FIG 6

SANDAL

RELATED APPLICATION

This application is a continuation in part of U.S. application Ser. No. 09/174,376 filed Oct. 16, 1998, now abandoned, the subject matter of which is incorporated herein by reference.

BACKGROUND OF THE INVENTION

1. Field of the Invention

The present invention relates to a sandal and more particularly pertains to assisting in spreading a wearer's toes during pedicure and medical treatment and the like.

2. Description of the Prior Art

The use of sandals of known designs and configurations is known in the prior art. More specifically, sandals of known designs and configurations heretofore devised and utilized for the purpose of assisting in the treatment of feet and toes through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,867,679 to Riehle et al discloses a foot corrective sandal. U.S. Pat. No. 2,751,693 to Baker discloses a toe spacing sandal. U.S. Pat. No. 5,802,737 to Beppu discloses a thong type sandal. U.S. Pat. No. 5,870,837 discloses a combination pedicure.

While these devices fulfill their respective, particular objectives and requirements, the aforementioned patents do not describe a sandal that allows assisting in spreading a wearer's toes during pedicure and medical treatment and the like.

In this respect, the sandal according to the present invention substantially departs from the conventional concepts and designs of the prior art, and in doing so provides an apparatus primarily developed for the purpose of assisting in spreading a wearer's toes during pedicure and medical treatment and the like.

Therefore, it can be appreciated that there exists a continuing need for a new and improved sandal which can be used for assisting in spreading a wearer's toes during pedicure and medical treatment and the like. In this regard, the present invention substantially fulfills this need.

SUMMARY OF THE INVENTION

In view of the foregoing disadvantages inherent in the known types of sandals of known designs and configurations now present in the prior art, the present invention provides an improved sandal. As such, the general purpose of the present invention, which will be described subsequently in greater detail, is to provide a new and improved sandal and method which has all the advantages of the prior art and none of the disadvantages.

To attain this, the present invention essentially comprises a sandal system for assisting in spreading a wearer's toes during pedicure and medical treatment or the like. A sole portion is first provided. The sole portion has a curved front end and a curved rear end. The sole portion also has a pair of sides. At least one side of the sole portion is formed in a serpentine fashion. The sole portion is comprised of a plurality of layers of elastomeric material. A planar lower layer is adapted to be positioned on the ground. An upper layer is adapted to receive the foot of a wearer thereon. The upper layer has a planar rear section and a planar front section. The upper layer also has an angling intermediate section between the front and rear sections. The sole portion also includes a plurality of intermediate layers. One intermediate layer is contoured to provide the positioning of the upper layer at a higher elevation at its rear portion than its front portion. In this manner a wearer's foot is urged forwardly. The upper layer has a pair of longitudinal slits adjacent to its rear. Four circular holes are provided adjacent to the front of the upper layer. A toe strap is next provided. The toe strap has an upper section. The upper section is positionable over the instep of a wearer's foot. The toe strap also has a lower section. The lower section is positioned through the slits and extends there beneath. The strap has four apertures adjacent to the forward edge thereof in the upper portion. Two cords with four central extents are provided. Each cord has two central elongated sections in a generally vertical orientation. Each cord also has two upper extents extending through associated apertures of the strap. Each cord also has two lower extents looped around the holes in the upper layer. Four cylindrical sleeves are provided. The sleeves are constructed of a deformable plastic material. Each sleeve encompasses the cords between the top surface and the upper layer and the lower edge of the strap. Each sleeve may be opaque or transparent to allow viewing of the cord there within. The sleeves are adapted to receive a wearer's toes there between. In this manner when the foot is urged forwardly by the shape of the sole portion separation of the toes is effected for pedicure and medical treatment and the like.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sandal which has all of the advantages of the prior art sandals of known designs and configurations and none of the disadvantages.

It is another object of the present invention to provide a new and improved sandal which may be easily and efficiently manufactured and marketed.

It is further object of the present invention to provide a new and improved sandal which is of durable and reliable constructions.

An even further object of the present invention is to provide a new and improved sandal which is susceptible of a low cost of manufacture with regard to both materials and labor, and which accordingly is then susceptible of low prices of sale to the consuming public, thereby making such sandal economically available to the buying public.

Even still another object of the present invention is to provide a sandal for assisting in spreading a wearer's toes during pedicure and medical treatment and the like.

Lastly, it is an object of the present invention to provide a new and improved sandal including a sole portion having a front end and a rear end and a pair of sides. The sole portion is comprised of a plurality of layers of elastomeric material including a planar lower layer, an angling intermediate portion, and an upper layer adapted to receive the foot of a wearer thereon. The sole portion includes a plurality of intermediate layers. The upper layer is provided with a pair of longitudinal slits adjacent to the rear thereof and four circular holes adjacent to the front thereof. A top strap has an upper section positionable over the instep of a wearer's foot and a lower section positioned through the slits and extending there beneath. The strap has four apertures adjacent to the forward edge thereof in the upper portion. Four cords each have an upper extent extending through an associated aperture of the strap and a lower extent looped around the holes in the upper layer. Four cylindrical sleeves encompass the cords.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view taken along line 3—3 of FIG. 1.

FIG. 4 is a front elevational view taken along line 4—4 of FIG. 3.

FIG. 5 is a cross sectional view taken along line 5—5 of FIG. 1.

FIG. 6 is an enlarged top elevational view illustrating the spreading of toes of a wearer when utilizing the sandal of the present invention.

The same reference numerals refer to the same parts through the various Figures.

DESCRIPTION OF THE PREFERRED EMBODIMENT

Figure 1:
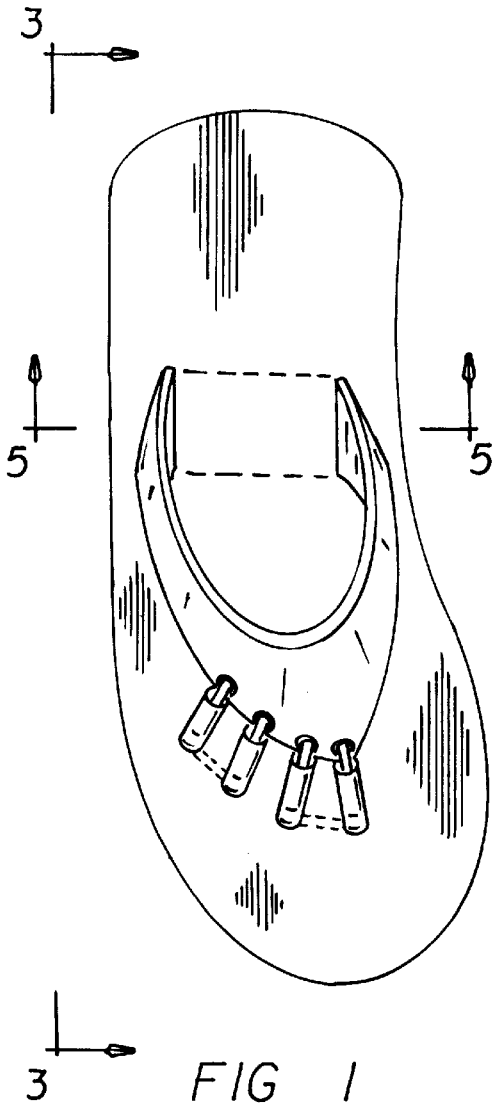
FIG. 1 is a top elevational view of the new and improved sandal constructed in accordance with the principles of the present invention.
Figure 2:
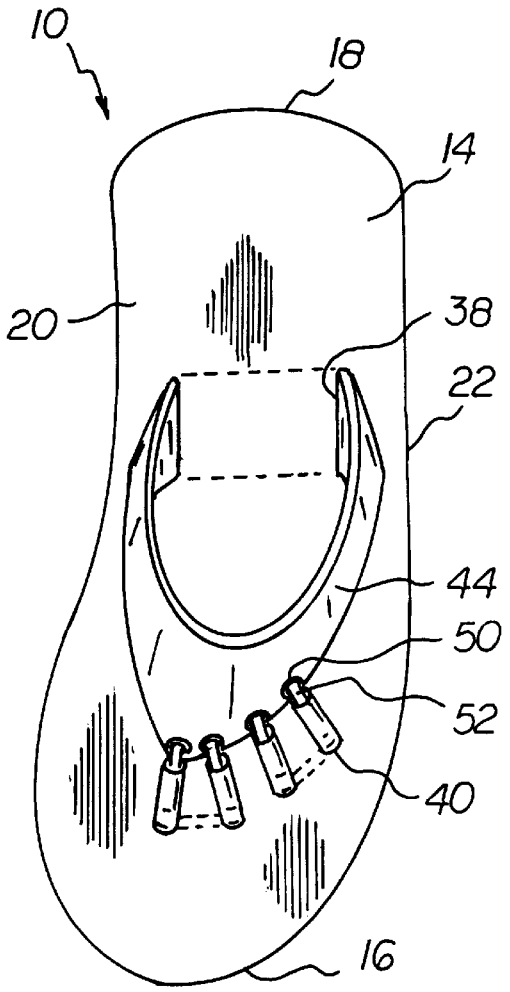
FIG. 2 is a top elevational view of the new and improved sandal constructed in accordance with the principles of the present invention.

With reference now to the drawings, and in particular to FIG. 1 thereof, the preferred embodiment of the new and improved sandal embodying the principles and concepts of the present invention and generally designated by the reference numeral 10 will be described.

The present invention, the sandal 10 is comprised of a plurality of components. Such components in their broadest context include a sole portion, a top strap, four cords and four cylindrical sleeves. Such components are individually configured and correlated with respect to each other so as to attain the desired objective.

A sole portion 14 is first provided. The sole portion has a curved front end 16 and a curved rear end 18. The sole portion also has a pair of sides 20, 22. At least one side 20 of the sole portion is formed in a serpentine fashion. The sole portion is comprised of a plurality of layers of elastomeric material. A planar lower layer 24 is adapted to be positioned on the ground. An upper layer 26 is adapted to receive the foot of a wearer thereon. The upper layer has a planar rear section 28 and a planar front section 30. The upper layer also has an angling intermediate section 32 between the front and rear sections. The sole portion also includes a plurality of intermediate layers 34, 36. One intermediate layer 34 is contoured to provide the positioning of the upper layer at a higher elevation at its rear portion than its front portion. In this manner a wearer's foot is urged forwardly. The upper layer has a pair of longitudinal slits 38 adjacent to its rear. Four circular holes 40 are provided adjacent to the front of the upper layer.

A toe strap 44 is next provided. The toe strap has an upper section 46. The upper section is positionable over the instep of a wearer's foot. The toe strap also has a lower section 48. The lower section is positioned through the slits and extends there beneath. The strap has four apertures adjacent to the forward edge thereof in the upper portion.

Two cords 52 with four central extents are provided. Each cord has two central elongated sections 54 in a generally vertical orientation. Each cord also has two upper extents 56 extending through associated apertures of the strap. Each cord also has two lower extents 58 looped around the holes in the upper layer.

Four cylindrical sleeves 62 are provided. The sleeves are constructed of a deformable plastic material. The deformable plastic material of the sleeves may be opaque or it may be transparent to allow viewing of the cord there within. Each sleeve encompasses the cords between the top surface and the upper layer and the lower edge of the strap. The sleeves are adapted to receive a wearer's toes there between. In this manner when the foot is urged forwardly by the shape of the sole portion separation of the toes is effected for pedicure and medical treatment and the like.

The soft, padded eva plastic upper of the present invention provides containment for the foot, as well as supporting the thong-toe separators in an upright position to adequately separate the toes.

The immovable thong-toe separators are constructed of plastic tubing that separates the toes. The tubing provides some flexibility, or give, allowing adjustment for different toe spacing.

The separators are constructed of a material that will not absorb oils from the foot, from pedicure treatments or medical treatments, thus allowing for a sanitary surface. The entire sandal which is constructed of different plastics allows for easy sanitization of the sandal.

Because there are no movable parts, the sandal upper and thong-toe separators provide a firm foundation for walking outside on uneven surfaces, such as hills, parking lots, store floors. The sandal of the present invention can be worn immediately after a pedicure or medical treatment to pursue chores such as shopping, etc. The stability and protection is not found in the prior art.

The thick sole of the sandal of the present invention slopes down from heel to toe and pushes the space between the toes into the thong-like separators preventing them for slipping while walking on uneven surfaces. The thick sole also allows for comfortable movement over uneven surfaces. This allows the sandal of the present invention to be used while pursuing chores in the outside environment. The prior art inventions are not designed for use outdoors.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sandal comprising:

a sole portion having a front end and a rear end and a pair of sides, the sole portion being comprised of a plurality of layers of elastomeric material including a planar lower layer and an upper layer adapted to receive the foot of a wearer thereon, the upper layer having an angling intermediate section, the sole portion also including a plurality of intermediate layers, the upper layer having a pair of longitudinal slits adjacent to the rear thereof and four circular holes adjacent to the front thereof;

a top strap having an upper section positionable over the instep of a wearer's foot and a lower section positioned through the slits and extending there beneath, the strap having four apertures adjacent to the forward edge thereof in the upper portion;

two cords with four central extents each cord having two upper extents extending through associated apertures of the strap and having two lower extents looped around the holes in the upper layer; and four cylindrical sleeves encompassing the cords.

2. The sandal as set forth in claim 1 wherein the cylindrical sleeves are transparent.

3. The sandal as set forth in claim 1 wherein the cylindrical sleeves are opaque.

4. The sandal as set forth in claim 1 wherein the intermediate layers include one layer contoured to provide the positioning of the upper layer at a higher elevation at its rear portion than its front portion for positioning a wearer's foot forwardly.

5. A new and improved sandal system for assisting in spreading a wearer's toes during pedicure and medical treatment and the like comprising, in combination:

a sole portion having a curved front end and a curved rear end and a pair of sides, at least one side of which is in a serpentine fashion, the sole portion being comprised of a plurality of layers of elastomeric material including a planar lower layer adapted to be positioned on the ground and an upper layer adapted to receive the foot of a wearer thereon, the upper layer having a planar rear section and a planar front section and an angling intermediate section there between, the sole portion also including a plurality of intermediate layers including one layer contoured to provide the positioning of the upper layer at a higher elevation at its rear portion than its front portion for urging a wearer's foot forwardly, the upper layer having a pair of longitudinal slits adjacent to the rear thereof and four circular holes adjacent to the front thereof;

a toe strap having an upper section positionable over the instep of a wearer's foot and a lower section positioned through the slits and extending there beneath, the strap having four apertures adjacent to the forward edge thereof in the upper portion;

two cords with four central extents each cord having two central elongated sections in a generally vertical orientation and having two upper extents extending through associated apertures of the strap and having two lower extents looped around the holes in the upper layer; and four cylindrical sleeves of a deformable plastic material, each encompassing the cords between the top surface and the upper layer and the lower edge of the strap, the sleeves adapted to receive a wearer's toes there between to effect their separation for pedicure and medical treatment and the like when the foot is urged forwardly by the shape of the sole portion.

* * * * *